US006435059B1

(12) United States Patent
Martinez

(10) Patent No.: US 6,435,059 B1
(45) Date of Patent: Aug. 20, 2002

(54) LIGHT-WEIGHT STRIKING TOOL

(76) Inventor: Mark R. Martinez, 2785 Clydsdale Ave., Atwater, CA (US) 95301

( * ) Notice: Subject to any disclaimer, the term of this patent is extended or adjusted under 35 U.S.C. 154(b) by 0 days.

(21) Appl. No.: 09/636,465

(22) Filed: Aug. 11, 2000

Related U.S. Application Data

(60) Provisional application No. 60/148,941, filed on Aug. 13, 1999.

(51) Int. Cl.[7] ..... B25D 1/00

(52) U.S. Cl. ..... 81/20; 30/308.1; 81/900

(58) Field of Search ..... 87/20, 900; 30/308.1

(56) References Cited

U.S. PATENT DOCUMENTS

| | | | | |
|---|---|---|---|---|
| 974,021 | A | 10/1910 | Blake | |
| 988,402 | A | 4/1911 | Strandberg | |
| 2,566,517 | A | 9/1951 | Dicks | |
| 2,776,689 | A | 1/1957 | Falzone | |
| 3,721,282 | A | 3/1973 | Hayes et al. | |
| 3,793,656 | A | 2/1974 | Songer et al. | |
| 3,942,567 | A | 3/1976 | Richilano | |
| 4,023,221 | A | 5/1977 | Cadman | |
| 4,091,871 | A | 5/1978 | Chiaramonte et al. | 168/4 |
| 4,139,930 | A | 2/1979 | Cox | |
| 4,465,115 | A | 8/1984 | Palomera | |
| 4,876,928 | A | 10/1989 | Gaulin | |
| 5,024,437 | A | 6/1991 | Anderson | |
| 5,028,049 | A | 7/1991 | McKeighen | |
| 5,088,174 | A | 2/1992 | Hull et al. | |
| 5,094,383 | A | 3/1992 | Anderson et al. | |
| 5,141,353 | A | 8/1992 | Meredith et al. | |
| 5,255,575 | A | 10/1993 | Williams | |
| 5,359,911 | A | 11/1994 | Kruesi | |
| 5,499,984 | A | 3/1996 | Steiner et al. | |
| 5,657,541 | A | 8/1997 | Hickok et al. | |
| 5,766,091 | A | 6/1998 | Humphrey et al. | |
| 5,817,962 | A | 10/1998 | Behrenfeld | |
| 5,863,268 | A | 1/1999 | Birch | |
| 5,864,955 | A | 2/1999 | Hirai | 30/350 |
| 5,879,243 | A | 3/1999 | Hackman | |
| 5,897,407 | A | 4/1999 | Mendelson | 440/49 |
| 5,906,550 | A | 5/1999 | Kingston | |

FOREIGN PATENT DOCUMENTS

| | | |
|---|---|---|
| GB | 2 039 815 A | 8/1980 |
| JP | 2-95871 | 4/1990 |
| JP | 06-205856 | 7/1994 |
| JP | 10-314346 | 12/1998 |
| JP | 11-004920 | 1/1999 |

OTHER PUBLICATIONS

Annalee Yassi; Repetitive strain injuries; The Lancet, vol. 349, Mar. 29, 1997, pp. 943–947, University of Manitoba, Canada.

*Primary Examiner*—James G. Smith
(74) *Attorney, Agent, or Firm*—Pennie & Edmonds LLP

(57) ABSTRACT

A striking tool having a handle with a head attached thereto. The head having a striking surface. The head being constructed of titanium or titanium based alloy so that the tool can be swung with a higher velocity than a striking tool having a heavier steel head of comparable size with no loss in effective striking force.

20 Claims, 2 Drawing Sheets

LIGHT-WEIGHT STRIKING TOOL

This application claims the benefit of provisional application Ser. No. 60/148,941 filed Aug. 13, 1999.

FIELD OF THE INVENTION

The present invention is in the area of hand-held striking tools, such as hammers, and pertains more specifically to the weights and swinging dynamics of such tools, accommodating a demand for a variety of weights for such tools, and improving claw hammer versatility.

BACKGROUND OF THE INVENTION

Hand-held striking tools, such as claw hammers, have been used by people in a variety of disciplines for centuries as leveraged devices to provide a striking force to accomplish a seemingly endless variety of tasks. For example, a steel claw hammer, commonly weighing from 7 to 32 ounces is used by people doing carpentry work to deliver sufficient striking force to drive a nail into wood. A claw hammer is also used for removing a nail or ripping apart lumber using it's claw. A sledge hammer, commonly weighing from 2 to 20 pounds, is used to deliver sufficient striking force for heavy work such as driving a stake, Rawl drill, chisel, or driving a wedge into masonry, stone, wood, or other hard materials.

Hand-held striking tools, such as those described above, are commonly used as third-class levers used to provide a striking force to accomplish tasks such as driving a nail into a piece of wood, bending or forming metal, breaking a rock, and other similar tasks. Third class levers are levers where a fulcrum, also referred to as a pivot point, is at one end of a bar or rod. A load to be overcome is an object creating resistance at the opposite end of a bar or rod. An effort, or force, to be applied to a third-class lever is somewhere in between a fulcrum and load. In the case of a hand-held striking tool such as a claw hammer, the fulcrum is a wrist. The force is provided by deceleration of the movement of a hammer handle (bar or rod) at the wrist, and the load is a resistance presented by a piece of wood into which the nail is being driven.

The head is at a distance from the fulcrum and moves faster than the movement being applied at a user's hand, which is near the fulcrum. The increased speed of the head multiplies the applied force with which a striking device head strikes a nail or digs into the dirt. The longer a claw hammer's handle, for example, the faster the head and the greater the force that strikes a nail and overcomes the resistance of the wood. This principle applies to all other hand-held striking devices, and is intensified in long-handled striking devices such as a pickaxe or an axe.

The load for a hand-held striking tool being used as a first class lever, such as in a claw hammer or a pickaxe, is typically very close to the fulcrum. Whereas the force for a hand-held striking tool being used as a third class lever is typically relatively far away from the fulcrum. During prying or pulling tasks, the load applied is therefore moved less distance than the hand, which is at the opposite end of the lever, and applying the force. This multiplies the force in which the claw hammer head pulls against a nail, or a pickaxe pulls against a rock.

As described above, hand-held striking devices typically come in a variety of weights, depending upon the task at hand or the physical condition of the user. For example, claw-hammers used for general carpenter work, commonly referred to as a curved-claw nail hammer, are typically manufactured and sold in weights from 7 to 20 ounces. Claw hammers designed and used for rough work such as framing, opening crates and prying apart boards, commonly referred to as ripping hammers, are typically manufactured and sold in weights from 20 to 32 ounces. The primary difference between a curved nail hammer and a ripping hammer is that the ripping hammer has a substantially straighter and longer claw than a curved nail claw.

Referring now to the fact of hammers of various weights, and the fact of the common and known materials used for hammer heads, there is a definite correlation between the size and general dimensions of a hammer head and the weight of the hammer head. The correlation causes some problems and narrows the scope of possibilities in dimension vs. weight for hammer heads.

What is clearly needed is a new material for hammer heads that is tough and strong, capable of hard surfaces, and lighter for size than hammers currently made.

DESCRIPTION OF THE PREFERRED EMBODIMENTS

Figure 1:
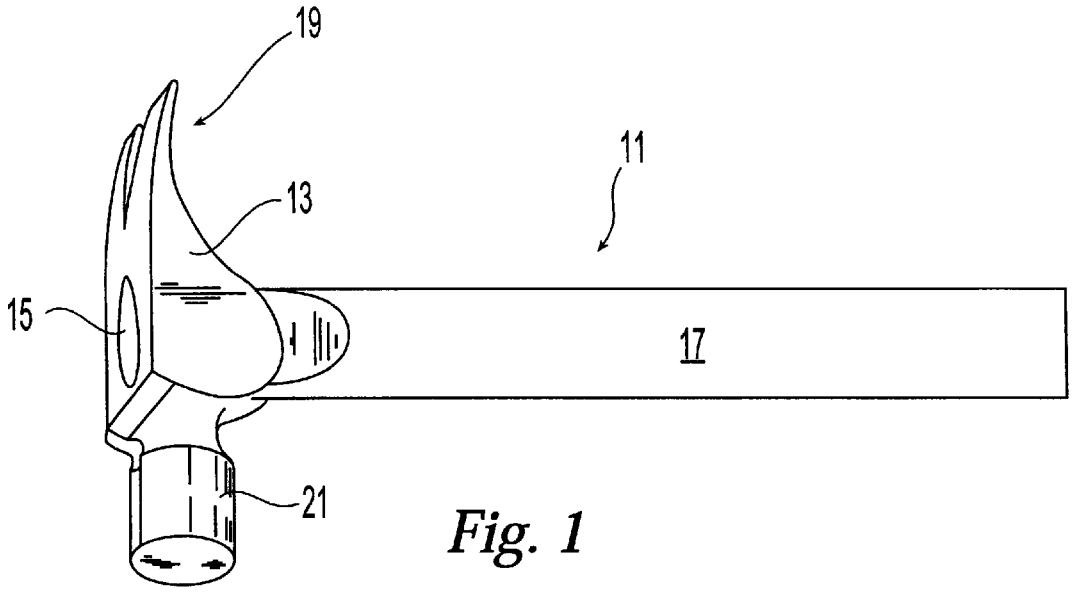
FIGS. 1 and 2 illustrate two hammers having heads according to the present invention.

FIG. 1 is a perspective view of a hammer 11 having a head according to an embodiment of the present invention. Hammer 11 has a head 13 made of 100% titanium in a preferred embodiment, and the head has an eye 15 for accommodating a handle 17 which in a preferred embodiment is wooden, but may be made of a number of other materials, such as highly-cross-linked polymer materials. The head of hammer 11 has a claw end 19 and a striking head 21. Head 11 may be made by investment casting or forging.

In a preferred embodiment the material of the head is titanium, which is lighter for volume than most materials, allowing full-size hammer heads to be made with relatively light weight. Because the head is lighter, in one embodiment about 14 oz. for a framing hammer as opposed to conventional framers of about 22 oz. Although it might at first appear that the striking force will be less because the lesser weight would perhaps translate to a lesser momentum, the inventor has discovered that the user, because of the lighter weight, swings the hammer to a higher velocity, and the momentum at striking, and therefore the effective striking force is the same as for a heavier hammer, or even higher.

In embodiments with the head made of pure titanium, without further heat treatment, the surface hardness of the striking face is about Rockwell 32, hard enough for many applications, and leading to a lower manufacturing cost than for materials where heat treating is a must. In applications where a harder striking surface is required, heat treating of titanium alloy hammer heads may be done to raise the hardness to Rockwell 55 or even higher.

Figure 3A:
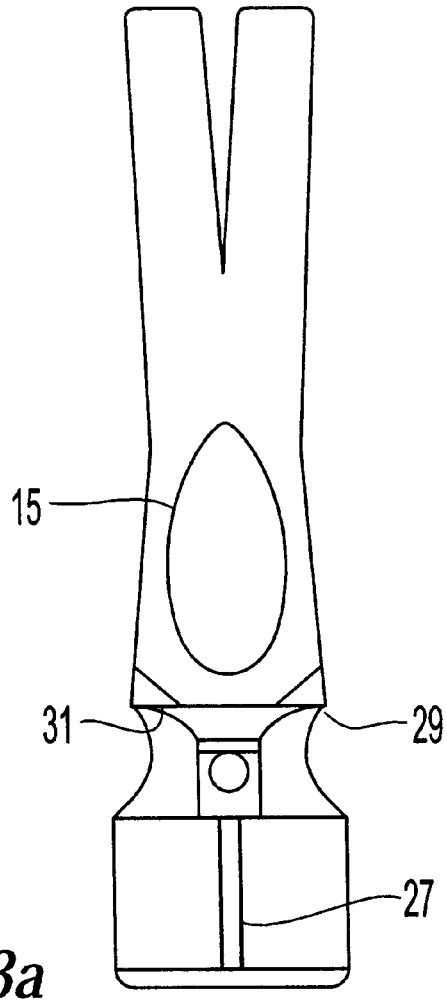
FIGS. 3*a,b,c* show features of hammers according to preferred embodiments of the present invention.
Figure 3B:
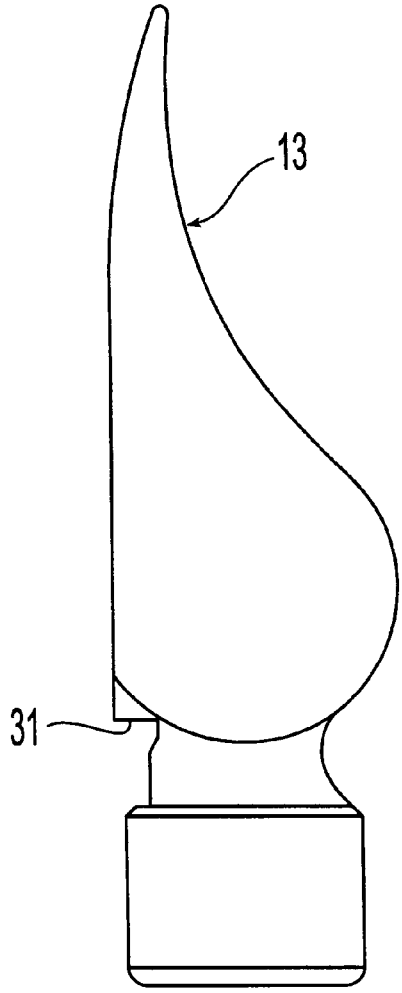
Figure 3C:
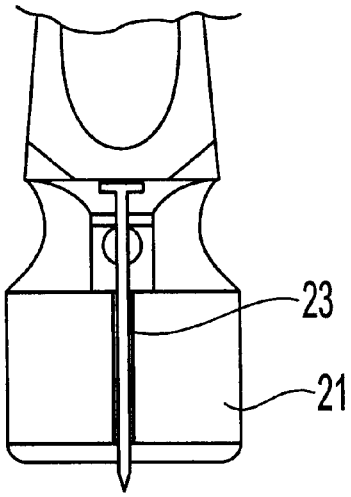

In some embodiments, as seen in head 13 in FIGS. 3*a–c* there is a nail holder groove 27 for holding a nail 23 for easy setting. Nail holding may be accomplished by using a magnetic head button portion 29. Striking surface 31 causes nail 23 to enter wood during initial starting stroke.

Figure 2:
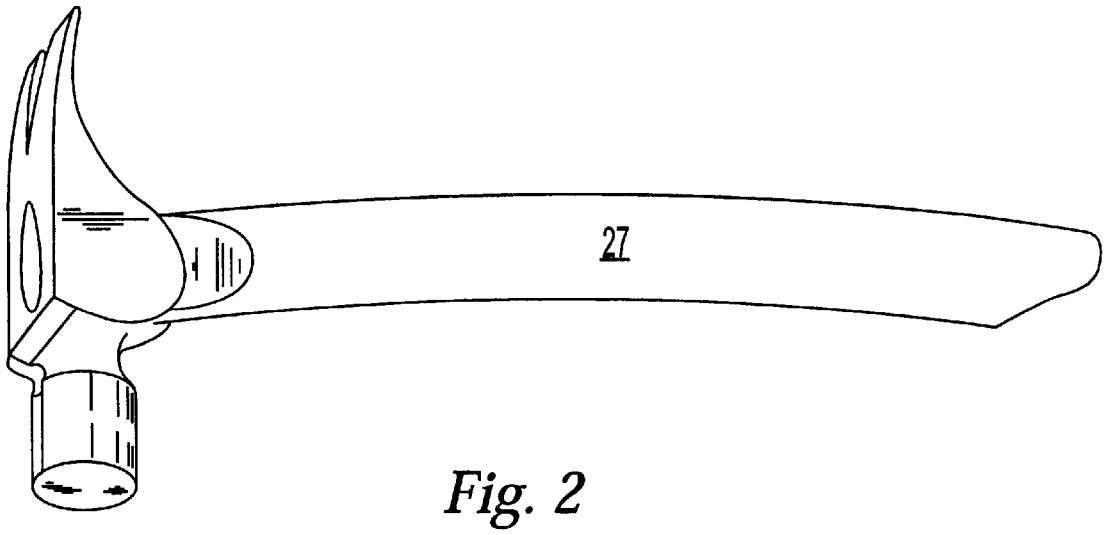

FIGS. 1 and 2 illustrate two models of titanium-headed hammers 17 and 27, one having a 14 oz. head and a straight wooden handle, and the other a 14 oz. head and a curved wooden handle. Again, handles may be of other materials as well. In some embodiments, depending on specific model requirements, titanium alloys may be used, with the majority of the material titanium.

The hammer as shown has an advantage in reducing repetitive-motion injuries and conditions, carpenter's elbow and carpel tunnel syndrome.

FIG. 3 shows features of titanium hammers according to embodiments of the present invention.

Alternatively, the hammer heads may be made from titanium. As used herein "titanium" means and includes titanium and titanium-based alloys as used in the industry for making golf club heads, brake rotors, and medical implants. To accomplish the reduced weight the head should be composed of titanium or an alloy of at least about 75 wt. % titanium and have high strength and hardness.

I claim:

1. A striking tool comprising:

an elongated handle having two ends; and a tool head having a striking surface, the tool head attached to a first handle end and comprising titanium or titanium-based alloy, whereby the tool head enables the striking tool to be swung with a higher velocity than a striking tool having a heavier steel tool head of comparable size with no resulting loss in effective striking force compared to the heavier tool head.

2. A striking tool of claim 1, wherein the striking surface is substantially flat.

3. A striking tool of claim 1, wherein the handle is made of wood.

4. A striking tool of claim 1, wherein the tool head is made of 100% titanium.

5. A striking tool of claim 4, wherein the striking surface has a hardness of about Rockwell 32.

6. A striking tool of claim 1, wherein the head is made of titanium-based alloy.

7. A striking tool of claim 6 wherein the titanium-based alloy comprises at least 75% titanium by weight.

8. A striking tool of claim 6, wherein the striking surface is heat treated to raise the surface hardness.

9. A striking tool of claim 8, wherein the surface hardness of the striking surface is at least Rockwell 55.

10. A striking tool comprising:

an elongated handle having two ends; and a tool head having a striking surface on a first end and an opposite second end, the tool head attached to a first handle end, the tool head comprising titanium or titanium-based alloy, whereby the tool head enables the striking tool to be swung with a higher velocity than a striking tool having a heavier tool steel head of comparable size with no resulting loss in effective striking force compared to the heavier tool head.

11. A striking tool of claim 10, further comprising the tool head having a claw on the opposite second end.

12. A striking tool of claim 10, wherein the tool head is made of 100% titanium.

13. A striking tool of claim 10, wherein the tool head is made of titanium-based alloy.

14. A striking tool comprising:

an elongated handle having two ends; and a tool head for striking an object, the tool head having two ends, the tool head attached to a first handle end and extending transversely thereto, the tool head being made of titanium or titanium-based alloy, whereby the tool head enables the striking tool to be swung with a higher velocity than a striking tool having a heavier steel tool head of comparable size with no resulting loss in effective striking force compared to the heavier tool head.

15. A striking tool of claim 14, wherein at least one end of the tool head has a substantially flattened striking surface.

16. A striking tool of claim 14, wherein at least one end of the tool head is pointed.

17. A striking tool of claim 14, wherein at least one end of the tool head is wedge-shaped.

18. A striking tool of claim 14, wherein the head is made of 100% titanium.

19. A striking tool of claim 14, wherein the head is made of titanium-based alloy.

20. A striking tool of claim 19, wherein the titanium-based alloy comprises at least 75% titanium by weight.

* * * * *